US009181141B2

(12) United States Patent
Lechner et al.

(10) Patent No.: US 9,181,141 B2
(45) Date of Patent: Nov. 10, 2015

(54) PROPELLANT CHARGE

(75) Inventors: Peter Simon Lechner, Oberasbach (DE); Rainer Hagel, Erlangen (DE); Reinhard Moller, Erlbach (DE)

(73) Assignee: RUAG AMMOTEC GMBH, Fürth (DE)

( * ) Notice: Subject to any disclaimer, the term of this patent is extended or adjusted under 35 U.S.C. 154(b) by 1309 days.

(21) Appl. No.: 12/175,567

(22) Filed: Jul. 18, 2008

(65) Prior Publication Data

US 2009/0084283 A1 Apr. 2, 2009

Related U.S. Application Data

(63) Continuation of application No. 10/542,319, filed as application No. PCT/EP2004/000197 on Jan. 14, 2004, now abandoned.

(30) Foreign Application Priority Data

Jan. 14, 2003 (DE) ..... 103 01 123

(51) Int. Cl.

| | |
|---|---|
| ***C06B 33/00*** | (2006.01) |
| ***C06B 33/10*** | (2006.01) |
| ***C06C 7/00*** | (2006.01) |
| ***C06B 23/00*** | (2006.01) |
| ***C06B 23/04*** | (2006.01) |
| ***C06D 5/00*** | (2006.01) |

(52) U.S. Cl.

CPC ..... *C06C 7/00* (2013.01); *C06B 23/001* (2013.01); *C06B 23/04* (2013.01); *C06D 5/00* (2013.01)

(58) Field of Classification Search

CPC ..... C06B 33/10; C06B 33/00

See application file for complete search history.

(56) References Cited

U.S. PATENT DOCUMENTS

| | | | | |
|---|---|---|---|---|
| 1,406,176 | A * | 2/1922 | Fairburn | 44/507 |
| 3,135,636 | A | 6/1964 | McGirr | |
| 5,167,736 | A * | 12/1992 | Mei et al. | 149/22 |
| 2001/0054462 | A1 | 12/2001 | Hagel | |
| 2002/0179209 | A1 * | 12/2002 | Hagel et al. | 149/61 |

FOREIGN PATENT DOCUMENTS

| | | |
|---|---|---|
| DE | 2017633 | 4/1970 |
| EP | 0 704 415 B1 | 4/1996 |
| GB | 2 359 124 A | 8/2001 |
| WO | WO 98/17607 | 4/1998 |
| WO | WO 98/41810 | 9/1998 |

* cited by examiner

*Primary Examiner* — Aileen B Felton

(74) *Attorney, Agent, or Firm* — Fitch, Even, Tabin and Flannery LLP

(57) ABSTRACT

A propellant charge, a priming cap including the propellant charge and a weapons training system including the priming cap are characterized in that the propellant charge contains a soft friction agent. The propellant charge can contain at least one impact-sensitive explosive substance as a heavy-metal-free priming compound, and the soft friction agent can be marble, calcite, dolomite, soft carbonates and/or mixtures thereof.

19 Claims, No Drawings

PROPELLANT CHARGE

CROSS-REFERENCE TO RELATED APPLICATION

This application is a continuation application of U.S. application Ser. No. 10/542,319, filed Jul. 13, 2005, the contents of which are incorporated herein by reference.

The invention relates to propellant charges for weapons training systems.

Propellant charges for projectiles consist, as a rule, of high-energy substances, such as, for example, nitrocellulose or systems that are more thermally stable, as they have been developed and are used, for example, for motor vehicle safety in the form of gas compositions. These versions are rich in gas and produce the energy that is necessary to execute the projectile movement as a result of rapid and almost complete conversion. Thermodynamically this is manifested by the oxygen balance, the specific energy or by the heat of explosion. Such versions are of only limited suitable for weapons training systems, since they accelerate the training projectile too much.

The propellant charge in accordance with the invention contains, in addition to ignition substances that are free from heavy metals and are usual per se, friction agents and preferably no oxidizing and/or reducing agents. The friction agent simultaneously serves as an inert diluting agent and does not represent a reaction component. As friction agents in accordance with the invention such agents can be used that do not have any abrasive effect on weapons parts (soft friction agents). Marble, calcite, dolomite and/or soft carbonates, such as magnesium carbonate and/or calcium carbonate, may be mentioned as examples of friction agents. Mixtures of soft friction agents can also be used in accordance with the invention. If applicable, other conventional friction agents can also be admixed in the usual quantities with the propellant charge in accordance with the invention. Percussion-sensitive explosives are used as ignition substances that are free from heavy metals. Potassium dinitrobenzofuroxan and tetrazene may be mentioned by way of example. It is known that potassium dinitrobenzofuroxan and tetrazene can be used as components in ignition substances that are free from heavy metals, but mostly in the presence of oxidizing and reducing agents. A normal ignition composition such as this, consisting of the components previously described with oxidizing and reducing agents, is less suitable as a propellant charge for training systems. In contrast to the prior art, the presence of reducing agents is foregone in the composition in accordance with the invention. As a result, the further additions no longer act as oxidizing agents.

The kinetic energy of the projectile can be controlled for all types of weapons by varying the recipe of the propellant charge in accordance with the invention within wide limits. As a result, the excessive acceleration of the practice projectile described at the beginning is avoided.

The percussion-sensitive propellant charges in accordance with the invention can be loaded in conventional ignition caps. The ignition caps are not, however, used to ignite a propellant charge powder, but themselves form the gas-producing composition. The ignition caps containing the propellant charges in accordance with the invention can then be ignited, for example, by means of a primary percussion cap.

The percussion-sensitive propellant charges in accordance with the invention can contain 5 to 70% by weight, preferably 10 to 65% by weight, ignition substances that are free from heavy metals, with it also being possible in accordance with the invention to use mixtures of these ignition substances that are free from heavy metals. The friction agent in accordance with the invention can be used in quantities of 30 to 95% by weight, preferably in quantities of 35 to 80% by weight, with it also being possible in accordance with the invention to use mixtures of these friction agents.

Propellant-charge capacities of all the desired strengths can be realized by varying the composition make-up.

In this connection, the following positive observations were made:

no aerosol formation;

no weapon erosion as a result of soft friction agent;

still sufficient friction effect;

uniform adjustment of capacity possible.

The following make-ups may be mentioned by way of example:

| Capacity: | weak | medium | strong |
|---|---|---|---|
| Potassium dinitrobenzofuroxan | 20 wt % | 40 wt % | 50 wt % |
| Tetrazene | 0 wt % | 10 wt % | 15 wt % |
| Soft friction agent | 80 wt % | 50 wt % | 35 wt % |

The propellant charges in accordance with the invention can be used in weapons training systems.

The invention claimed is:

1. Propellant charge, comprisinq 5% to 70% by weight of at least one percussion-sensitive explosive and 30% to 95% by weight of at least one soft friction agent that does not represent a reaction component selected from the group consisting of marble, calcite, dolomite, soft carbonates and mixtures thereof.

2. Propellant charge according to claim 1, characterized in that the proportion of the at least one soft friction agent in the propellant charge is 35% to 80% by weight.

3. Propellant charge according to claim 1, characterized in that the at least one percussion-sensitive explosive is a heavy-metal-free priming compound.

4. Propellant charge according to claim 1, characterized in that the at least one percussion-sensitive explosive comprises potassium dinitrobenzofuroxanate and/or tetrazene.

5. , Propellant charge according to claim 1, characterized in that the proportion of the at least one percussion-sensitive explosive is from 10% to 65% by weight.

6. Propellant charge according to claim 1, characterized in that the propellant charge has the following composition: 20% by weight potassium dinitrobenzofuroxanate and 80% by weight marble powder.

7. Propellant charge according claim 1, characterized in that the propellant charge has the following composition: 40% by weight potassium dinitrobenzofuroxanate, 10% by weight tetrazene, 50% by weight marble powder.

8. Propellant charge according to claim 1, characterized in that the propellant charge has the following composition: 50% by weight potassium dinitrobenzofuroxanate, 15% by weight tetrazene, 35% by weight marble powder.

9. Propellant charge according to claim 1, characterized in that the propellant charge can be loaded in primer caps and can be ignited by a primary percussion cap.

10. A weapons training system comprising the propellant charge according to claim 1.

11. Propellant charge, comprising 20% to 65% by weight of at least one percussion-sensitive explosive and 35% to 80% by weight of at least one soft friction agent selected from the group consisting of marble, calcite, dolomite, soft carbonates and mixtures thereof.

12. Propellant charge according to claim 11, characterized in that the soft friction agent is selected from the group of marble, calcite, dolomite, soft carbonates and/or mixtures thereof.

13. Propellant charge according to claim 11, characterized in that the at least one percussion-sensitive explosive is a heavy-metal-free priming compound.

14. Propellant charge according to claim 11, characterized in that the at least one percussion-sensitive explosive comprises potassium dinitrobenzofuroxanate and/or tetrazene.

15. Propellant charge, consisting essentially of 5% to 70% by weight of at least one percussion-sensitive explosive and 30% to 95% by weight of at least one soft friction agent selected from the group consisting of marble, calcite, dolomite, soft carbonates and mixtures thereof.

16. Propellant charge according to claim 15, characterized in that the soft friction agent is selected from the group of marble, calcite, dolomite, soft carbonates and/or mixtures thereof.

17. Propellant charge according to claim 15, characterized in that the at least one percussion-sensitive explosive is a heavy-metal-free priming compound.

18. Propellant charge according to claim 15, characterized in that the at least one percussion-sensitive explosive comprises potassium dinitrobenzofuroxanate and/or tetrazene.

19. Propellant charge according to claim 15, characterized in that the proportion of the at least one soft friction agent in the propellant charge is 35% to 80% by weight.

* * * * *